United States Patent [19]

von Hagen et al.

[11] Patent Number: 4,457,247

[45] Date of Patent: Jul. 3, 1984

[54] THREAD CONTROL MECHANISM FOR SEWING MACHINES

[75] Inventors: Wolf-Rüdiger von Hagen; Erwin Jürgens, both of Hemmingen; Helmut Bauer, Stuttgart, all of Fed. Rep. of Germany

[73] Assignee: Union Special GmbH, Stuttgart, Fed. Rep. of Germany

[21] Appl. No.: 426,484

[22] Filed: Sep. 29, 1982

[30] Foreign Application Priority Data

Oct. 10, 1981 [DE] Fed. Rep. of Germany ..... 3140377

[51] Int. Cl.[3] ..... D05B 49/00

[52] U.S. Cl. ..... 112/302; 112/245; 112/254

[58] Field of Search ..... 112/245, 254, 302

[56] References Cited

U.S. PATENT DOCUMENTS

| | | | |
|---|---|---|---|
| 215,841 | 5/1879 | Towe | 112/245 |
| 827,654 | 7/1906 | Onderdonk | 112/245 |
| 2,688,294 | 9/1954 | McCloud | 112/302 |
| 2,997,010 | 8/1961 | Huges | 112/254 |
| 3,368,508 | 2/1968 | Angele | 112/245 |
| 3,605,659 | 9/1971 | Illes et al. | 112/302 X |
| 4,356,781 | 11/1982 | Rodda | 112/245 X |

*Primary Examiner*—Henry Jaudon
*Assistant Examiner*—Andrew M. Falik
*Attorney, Agent, or Firm*—John W. Hardst; John A. Schaerli

[57] ABSTRACT

A needle thread control mechanism for sewing machines which permits a machine operator to adjust the stitch tightness includes a thread take-up mechanism arranged wholly outside of the machine frame and a thread controlling mechanism arranged directly between the needle thread take-up mechanism and a thread supply source. A thread controller, adapted to cooperate with the thread take-up mechanism, is also provided.

8 Claims, 2 Drawing Figures

THREAD CONTROL MECHANISM FOR SEWING MACHINES

FIELD OF THE INVENTION

This invention generally relates to sewing machines, and more particularly, to a sewing machine needle thread control mechanism.

BACKGROUND OF THE INVENTION

The need and want for a machine capable of producing various stitch tightness was recognized in U.S. Pat. No. 3,654,883 granted Apr. 11, 1972 to G. M. Reimer et al. The need for such a machine was not dissipated with age. The Reimer invention, however, was not a total solution to the requirements of industry. The known state of the art required several thread pulloffs and had multiple deflections of needle thread resulting in high costs. Furthermore, the oscillating and extended thread eyelet in Reimer requires a breach or void in the machine casting. Such void provides a noise and lubricant passageway to the machine exterior. Of course, any lubricant leakage to the machine exterior may result in workpiece spoilage and thus is a severe drawback. Also, with today's every increasing concerns for quieter machines, the noise emission outlet provided by the thread eyelet opening in the machine casting was, and remains, a drawback. The cost and difficulty in covering such casting breach is apparent.

SUMMARY OF THE INVENTION

Because of the above, and in accordance with the present invention, there is provided a thread controlling mechanism for sewing machines which satisfies the needs and wants of the sewing machine trade, in a simple and less expensive manner from prior mechanisms. In addition, the present invention abates the problems of lubricant leakage and noise emission.

The needle thread control mechanism of the present invention includes a thread take-up means arranged wholly outside the machine frame and a thread handling or controlling mechanism. The thread controlling mechanism is directly disposed in the needle thread path extending between a well known thread tensioning mechanism and the thread take-up means. By this simple construction, the multiple thread bends and surplus eyelets heretofore required have been eliminated. The cost savings of such design is apparent. Moreover, having the needle thread control mechanism arranged wholly outside of the machine frame drastically reduces lubricant and noise emissions.

The needle thread control mechanism of the present invention includes stationary thread handling means arranged proximate the needle thread take-up mechanism and an operator influenced regulating means for preselecting the position of the thread handling means relative to the thread take-up mechanism. The preselected position of the thread handling means relative to the thread take-up means determines the extent or amount of thread introduced into the stitch and, thereby, determines the stitch tightness. Also provided is a thread controller. The thread controller is arranged in cooperation with the thread take-up means for controlling the setting of the stitch during the sewing operation.

In line with the above, a primary object of this invention is the provision of a thread control mechanism which enables an operator to change the manipulation of the needle thread to cause the formation of either tight or loose stitches over a wide range.

Another object of this invention is to provide an improved needle thread controlling mechanism which is adjustable whereby various predetermined amounts of needle thread may be made available for stitching purposes.

Another object of this invention is to provide a needle thread control mechanism which can be quickly and precisely adjusted to meet various sewing conditions without requiring any changes in the setting of the usual tensioning means.

Still another object of this invention is to provide a needle thread control mechanism which is readily accessible and is designed and arranged in a manner minimizing lubricant or noise emissions.

Yet another object of this invention is to provide a needle thread control mechanism wherein adjustment of the spacial relationship between the thread take-up means and the thread handling mechanism may be independently varied in both a horizontal and vertical direction to achieve the desired stitch tightness.

BRIEF DESCRIPTION OF THE DRAWINGS

Having in mind the above objects and other attendant advantages that would be evident from an understanding of this disclosure, the invention comprises the devices, combinations and arrangements of parts as illustrated in the presently preferred form of the invention which is hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
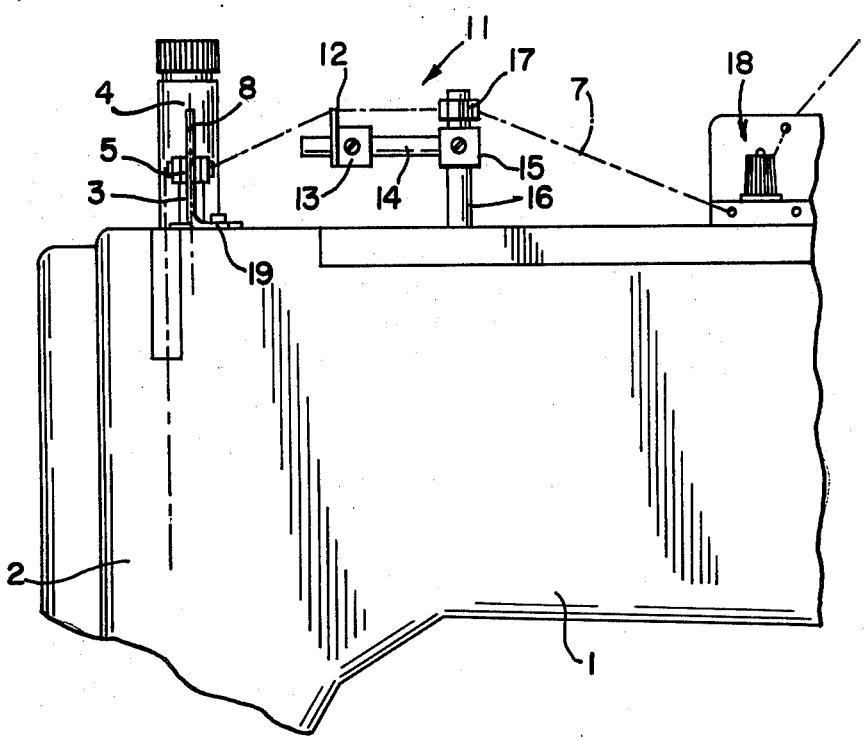
FIG. 1 is a fragmentary plan view of a sewing machine illustrated in the present invention.

Referring now in detail to the drawings, wherein like reference numerals indicate like parts throughout the several views, there is shown a sewing machine frame of which only a portion of the usual overhanging arm 1 is shown. At its free end, the arm terminates in a sewing machine head 2. Arranged for endwise reciprocation in the sewing machine head is a stitch forming mechanism including endwise reciprocal needle bar means 3 having one or more needles (not shown) carried at the lowermost extremity. In the usual manner, the needles are adapted to cooperate with suitable, well known loop taker means in the formation of a chain stitch seam. Also supported in the head 1, in the usual way, is a presser bar mechanism 4. Any suitable means may be provided for operating the stitch forming instrumentalities and presser bar mechanism.

The machine's needle thread take-up mechanism, which effectively manipulates the supply of needle thread to the stitch forming instrumentalities, will now be described. The thread take-up mechanism of the machine comprises a thread take-up bracket or member 5 adapted for movement along a path extending substantially parallel with the movement of the needle bar means. In its preferred form, the take-up bracket 5 is securely clamped to the top of the needle bar for linear oscillation or reciprocation therewith. The take-up member or lever 5 is provided with at least two laterally spaced thread engaging limbs which extend outward from the needle bar in substantially parallel planes. As well be subsequently described, the laterally spaced limbs of the lever 5 are positioned to straddle a thread controller 8. Each limb of the take-up member 5 being provided with one or more thread guiding eyelets 6 for accommodating a needle thread 7 and which defines a thread course.

Arranged in cooperation with the take-up mechanism is the thread controller 8 which is adapted to influence the thread during the stitch setting process of the sewing machine operation. As most clearly illustrated in FIG. 2, the presently preferred thread controller includes a generally planer thread contacting element having a curvilinear profile. The thread controlling element may be formed of sheet metal having an offset leg 19 (FIG. 1) which may be adjustably secured to the machine frame. The placement of the thread controlling element being such that it extends substantially perpendicular to the thread course extending between the thread guide eyelets. By this construction, the curvilinear thread engaging surface or profile of the thread controller 8 may be manipulated relative to the course or path of the thread extending between the outwardly extending limbs of the lever 5.

Figure 2:
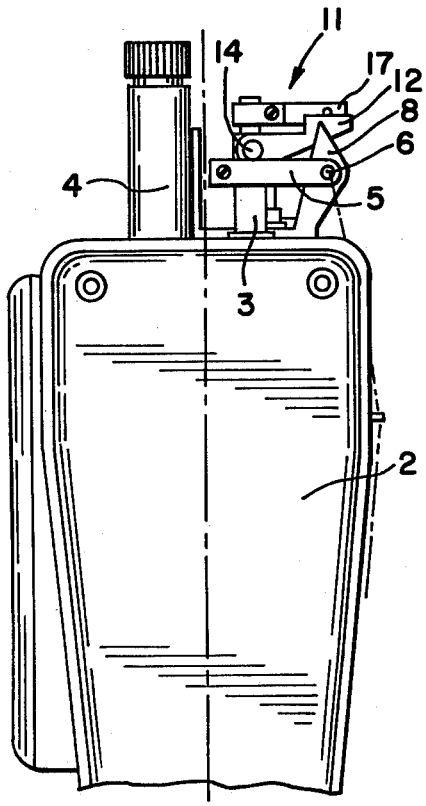
FIG. 2 is a side fragmentary view of the sewing machine shown in FIG. 1.

As may be best disclosed in FIG. 1, the flow of needle thread 7 extends from a suitable source, not herein shown, directly to well known, individual tension assembly means 18 from whence the thread passes to the needle thread take-up and thread controller and, ultimately, to the needles. The tensioning means 18 serve to control the flow of thread from the supply source to the stitch forming instrumentalities. Arranged directly in the path of thread flow, between the thread tensioning means 18 and thread take-up mechanism, there is provided a needle thread controlling mechanism 11. The needle thread controlling mechanism includes a stationary thread handling member 12 having means for guiding or handling the thread. The thread control mechanism further includes operator influenced regulating means 13 for laterally adjusting and securing the thread handling member in a normally stationary position. The adjustment path of the thread handling member extends generally parallel with the thread course. By this construction, the lateral position of the thread handling member may be selectively regulated, relative to the thread take-up mechanism, to preselect the amount of needle thread allowed into the stitch and ultimately into the seam.

In its presently preferred form, the regulating means 13 includes a slide that is shiftably supported on a horizontally disposed guide 14 in the form of a bar or rod. By this construction, the thread handling means 12 may be adjusted relative to the thread take-up means in or parallel to the direction of thread flow. In order to facilitate horizontal mounting of the guide 14, one end thereof is rigidily secured to a holder 15. The holder 15, in turn, is carried on a vertical support 16 which extends upwardly from an arm cover 21 arranged on the machine frame. With this preferred construction, the thread handling member 12 may also be vertically adjusted relative to the take-up mechanism. The vertical adjustment capability of the thread control mechanism enhances its ability to preselect the amount of needle thread introduced or allowed into the seam. At its free end, the support 16 may be provided with a thread guiding eyelet 17 which may be disposed between the thread tensioning member 18 and the thread handling member 12.

As will be readily apparent to those skilled in the art, the extent of needle thread introducted into the seam depends on the adjustment of the thread handling member relative to the thread take-up mechanism. Understandably, the amount or proportion of needle thread introduced may vary considerably from adjustment to adjustment. That is, when the thread guide 12 of the thread control mechanism 11 is laterally positioned proximate the guide eyelet 17 less needle thread enters into the seam. In contrast, when the thread guide 12 is arranged closer or nearer to the take-up mechanism more needle thread enters into the seam. Of course, the vertical adjustment of the thread guide 12 relative to the take-up mechanism may also affect the amount or extent of thread introduced into the seam.

Thus there has been provided a Thread Control Mechanism For Sewing Machines which fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Thus, having adequately described the invention, what we claim is:

1. In combination with a sewing machine having stitch forming instrumentalities including a reciprocal needle bar, thread tensioning means for controlling the flow of thread from a thread supply source to said stitch forming instrumentalities, and a thread handling system comprising:

thread take-up means including a linearly oscillatable lever adapted for movement along a path extending substantially parallel with the movement of said needle bar, said lever having at least two laterally spaced thread engaging limbs positioned to straddle at least one thread controller; and a thread controlling mechanism disposed directly in a flow of thread extending between said thread tensioning means and said thread take-up means, said thread controlling mechanism having thread handling means adapted for linear adjustment relative to said thread take-up means in the direction of thread flow such that in varying positions of adjustment said thread handling means cooperates with said thread take-up means to proportion the needle thread to produce varying stitch tightness.

2. The invention according to claim 1 wherein each laterally spaced thread engaging limb of said lever is provided with at least one thread guide adapted to accommodate a thread and which defines a thread course.

3. The invention according to claim 1 wherein the linear adjustment of said thread handling means extends substantially parallel with said thread course.

4. In combination with a sewing machine having stitch forming instrumentalities including reciprocal needle bar means, thread tensioning means for controlling the flow of thread from a thread supply source to said stitch forming instrumentalities, and a thread handling system comprising:

thread take-up means mounted on an upper end of said needle bar means including lower means for guiding thread across a profile of a thread controller means; and thread controlling mechanism means for preselecting the amount of thread drawn by said thread take-up means, said thread controlling mechanism means being directly disposed in the thread path extending between said thread take-up means and including adjustable thread handling means which may be selectively shifted in a generally horizontal direction relative to said thread take-up means.

5. In a sewing machine having stitch forming mechanism means including an endwise reciprocal needle bar, thread tensioning means for controlling the flow of thread from a source to said stitch forming instrument means, and a needle thread controlling device comprising:

reciprocally operated thread take-up means arranged on an upper end of said needle bar and including lever means for guiding thread across a profile of a thread controller; and thread controlling mechanism means adapted to cooperate with said thread take-up means and arranged directly in the thread path extending between said tensioning means and said thread take-up means, said thread controlling mechanism means includes thread handling element means and means for shifting said thread handling element means along a horizontal path and securing said element means in a preselected linear position relative to said thread take-up means.

6. In combination with a sewing machine having a frame, stitch forming instrumentalities including an endwise reciprocal needle bar, thread tensioning means for controlling the flow of thread from a thread supply source to said stitch forming instrumentalities and a needle thread control mechanism comprising:

movable thread take-up means including lever means operatively driven by said needle bar and effective to manipulate the supply of needle thread to said stitch forming instrumentalities;

stationary thread handling means arranged adjacent said lever means directly in the path of a thread passing from said tensioning means to said thread take-up means; and operator influenced regulating means operatively associated with said thread handling means for preselecting the amount of thread manipulated by said thread take-up means as a function of the horizontal position of said stationary thread handling means.

7. The invention according to claims 1 or 4 or 5 wherein at least one thread engaging eyelet means is disposed intermediate said thread tensioning means and said thread controlling mechanism means.

8. The invention according to claims 1 or 6 wherein said thread take-up means and said thread handling means are wholly positioned outside of said machine frame.

* * * * *